US011007799B2

(12) United States Patent
Iijima

(10) Patent No.: US 11,007,799 B2
(45) Date of Patent: May 18, 2021

(54) CUTTER UNIT SELECTIVELY PERFORMING ONE OF FULL-CUTTING AND HALF-CUTTING, AND PRINTER INCLUDING THE SAME

(71) Applicant: BROTHER KOGYO KABUSHIKI KAISHA, Nagoya (JP)

(72) Inventor: Shota Iijima, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/830,104

(22) Filed: Mar. 25, 2020

(65) Prior Publication Data

US 2020/0406640 A1 Dec. 31, 2020

(30) Foreign Application Priority Data

Jun. 28, 2019 (JP) ..... JP2019-122249

(51) Int. Cl.
*B41J 11/70* (2006.01)
*B41J 11/66* (2006.01)
*B41J 2/32* (2006.01)

(52) U.S. Cl.
CPC ..... *B41J 11/66* (2013.01); *B41J 2/32* (2013.01); *B41J 11/666* (2013.01); *B41J 11/70* (2013.01)

(58) Field of Classification Search
CPC ... B41J 11/66; B41J 11/666; B41J 2/32; B41J 3/4075; B41J 11/703; B26D 1/105;
(Continued)

(56) References Cited

U.S. PATENT DOCUMENTS 9,566,805 B2 * 2/2017 Kano ..... B26D 3/085
2012/0308289 A1 * 12/2012 Kosuge ..... B41J 11/009 400/621

(Continued)

FOREIGN PATENT DOCUMENTS

JP 2002-137864 A 5/2002
JP 2002-254385 A 9/2002

(Continued)

OTHER PUBLICATIONS

Machine translation of JP 2005-224924, published on Aug. 2005 (Year: 2005).*

*Primary Examiner* — Huan H Tran
(74) *Attorney, Agent, or Firm* — Kenealy Vaidya LLP

(57) ABSTRACT

A cutter unit includes a cutter holder, a cradle, a cutter lever, a cradle lever, and a transmitting portion. The cradle faces the cutter holder and movable between a full-cut position and a half-cut position. The cutter lever is configured to be contactable with the cutter holder. The cradle lever is configured to be contactable with the cradle. The transmitting portion is configured to move the cutter lever and the cradle lever in interlocking relation therebetween. The transmitting portion is configured to shut off transmission of movement of the cutter lever to the cradle lever in accordance with only operation to the cutter lever out of the cutter lever and the cradle lever while the transmitting portion is configured to transmit movement of the cradle lever to the cutter lever in accordance with only operation to the cradle lever out of the cutter lever and the cradle lever.

16 Claims, 11 Drawing Sheets

(58) Field of Classification Search
CPC ..... B26D 1/045; B26D 7/2628; B26D 5/10; B26D 3/12
See application file for complete search history.

(56) References Cited

U.S. PATENT DOCUMENTS

| | | | | |
|---|---|---|---|---|
| 2013/0021622 | A1* | 1/2013 | Yamaguchi | B41J 11/703 358/1.6 |
| 2013/0287467 | A1* | 10/2013 | Takahashi | B41J 11/703 400/621 |
| 2016/0288541 | A1 | 10/2016 | Kano et al. | |
| 2017/0083799 | A1* | 3/2017 | Naruse | G06K 15/005 |

FOREIGN PATENT DOCUMENTS

| | | | |
|---|---|---|---|
| JP | 2005-224924 | A | 8/2005 |
| JP | 2016-190289 | A | 11/2016 |

* cited by examiner

CUTTER UNIT SELECTIVELY PERFORMING ONE OF FULL-CUTTING AND HALF-CUTTING, AND PRINTER INCLUDING THE SAME

CROSS REFERENCE TO RELATED APPLICATION

This application claims priority from Japanese Patent Application No. 2019-122249 filed Jun. 28, 2019. The entire content of the priority application is incorporated herein by reference.

TECHNICAL FIELD

The present disclosure relates to a cutter unit and a printer including the cutter unit.

BACKGROUND

There has been known a cutter unit for cutting a cut item such as a tape, label, and tube. Further, a printer including the cutter unit for printing image on and cutting the tape, label and tube is also known. For example, Japanese Patent Application Publication No. 2005-224924 discloses a cutter unit including a motor for driving a movable blade so as to cut a label sheet in cooperation with a cutting table.

SUMMARY

According to the conventional cutter unit, weight of the unit is increased due to provision of the motor for driving the movable blade.

In view of the foregoing, it is an object of the disclosure to provide a light weight cuter unit, and a cutting unit including such cutter unit.

In order to attain the above and other objects, according to one aspect, the disclosure provides a cutter unit including a cutter holder, a cradle, a cutter lever, a cradle lever, and a transmitting portion. The cutter holder holds a cutter blade for cutting a cut item. The cutter holder is movable in a moving direction. The cradle faces the cutter holder and movable between a full-cut position where the cut item is subjected to full-cutting with the cutter blade and a half-cut position where the cut item is subjected to half-cutting with the cutter blade. The cutter lever is configured to be operated by a user, and contactable with the cutter holder to move the cutter holder. The cradle lever is configured to be operated by the user, and contactable with the cradle to move the cradle. The transmitting portion is configured to move the cutter lever and the cradle lever in interlocking relation therebetween. The transmitting portion is configured to shut off transmission of movement of the cutter lever to the cradle lever in accordance with only operation to the cutter lever out of the cutter lever and the cradle lever. The transmitting portion is configured to transmit movement of the cradle lever to the cutter lever in accordance with only operation to the cradle lever out of the cutter lever and the cradle lever.

According to another aspect, the disclosure provides a printer including a conveying portion, a print head and a cutter unit. The conveying portion is configured to convey an item to be printed. The print head is configured to perform printing on the item to be printed conveyed by the conveying portion. The cutter unit is configured to selectively perform one of full-cutting and half-cutting operation with respect to the item on which printing is performed by the print head. The cutter unit includes a cutter blade for cutting the item to be printed, a cradle and an extension portion. the cutter blade is movable. The cradle is positioned to face the cutter blade and movable in a movable direction between a full-cut position where the item to be printed is subjected to full-cutting with the cutter blade and a half-cut position where the item to be printed is subjected to half-cutting with the cutter blade, the cradle being formed with an opening having an inner surface. The extension portion is positioned in the opening, the extension having an outer surface. The outer surface of the extension portion and the inner surface of the opening face with each other in the movable direction with a gap therebetween. A dimension of the gap in the movable direction is changed in response to movement of the cradle in the movable direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, a printer 1 according to one embodiment of the present disclosure will be described with reference to FIGS. 1 through 3. Throughout the description, the terms "upward", "downward", "upper", "lower", "above", "below", "beneath", "right", "left", "front", "rear" and the like will be used assuming that the printer 1 is disposed in an orientation in which it is intended to be used. In use, the printer 1 is disposed as shown in FIG. 1.

Figure 1:
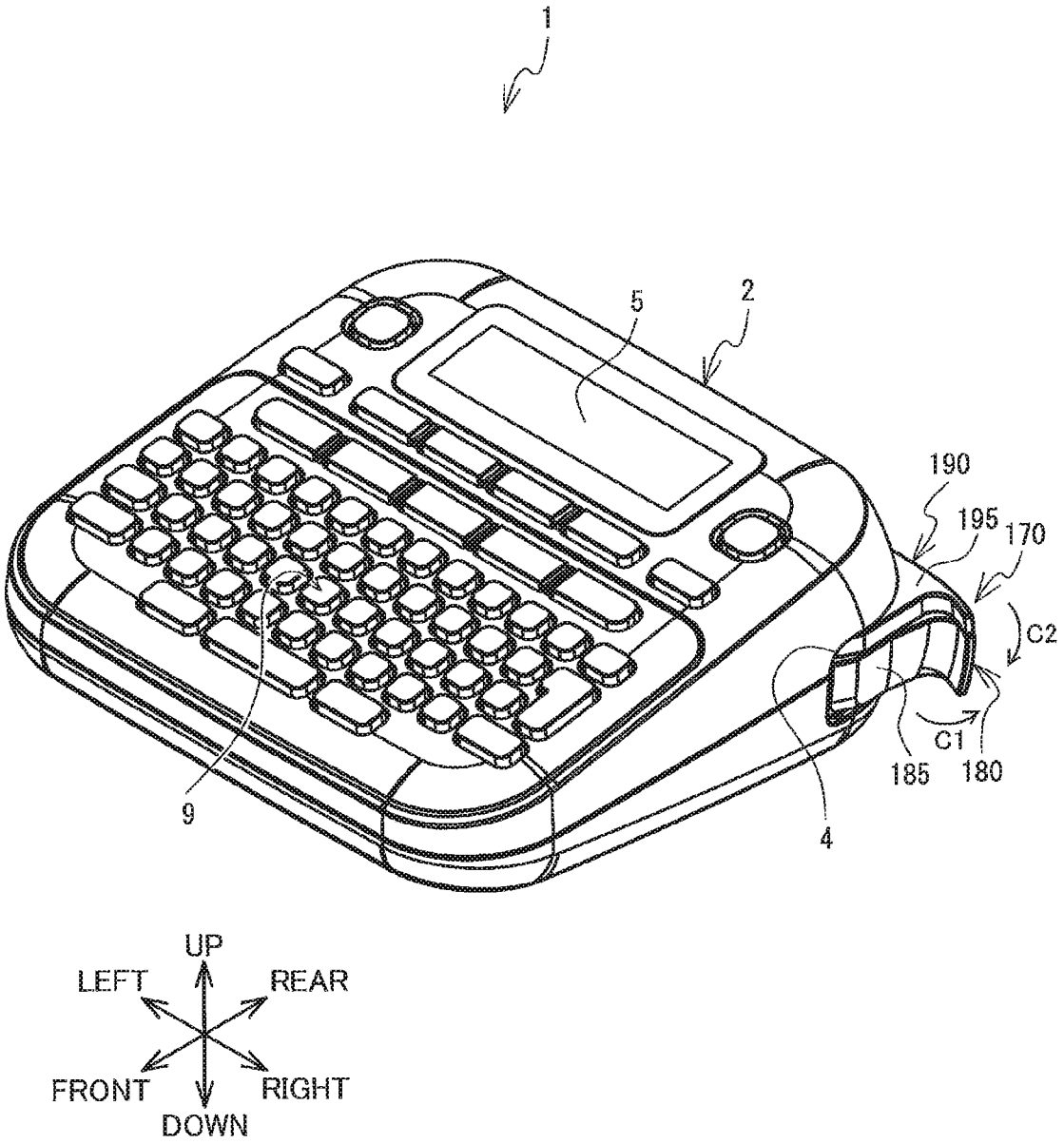
FIG. 1 is a perspective view of a printer 1 according to one embodiment.

As illustrated in FIG. 1, the printer 1 includes a housing 2, an operating portion 9, and a display portion 5. The housing 2 is generally square shape in plan view and is made from resin. The operating portion 9 is positioned at an upper front portion of the housing 2, and is configured to allow a user to input various information. The user directly touches the operating portion 9 to input information. The display portion 5 is positioned at the upper portion of the housing 2 and rearward of the operating portion 9. The display portion 5 is configured to display various information.

The housing 2 has a lower portion at which a cover (not illustrated) having a plate-like shape is movably provided.

The printer 1 includes a cassette receiving portion 6 (FIG. 2) which is opened or closed by the cover. A slot 4 is formed at a right rear portion of the housing 2. Further, an extension portion 113 (FIG. 7) extending in upward/downward direction is fixed to an inner portion of the housing 2. A fixing portion (not illustrated) is also fixed to the inner portion of the housing 2. Further, a shaft 104 (FIG. 5) is fixed to the inner portion of the housing 2. Further, a fixing member (not illustrated) is fixed to the housing 2. Further, a lever stopper (not illustrated) is fixed to the inner portion of the housing 2.

Figure 2:
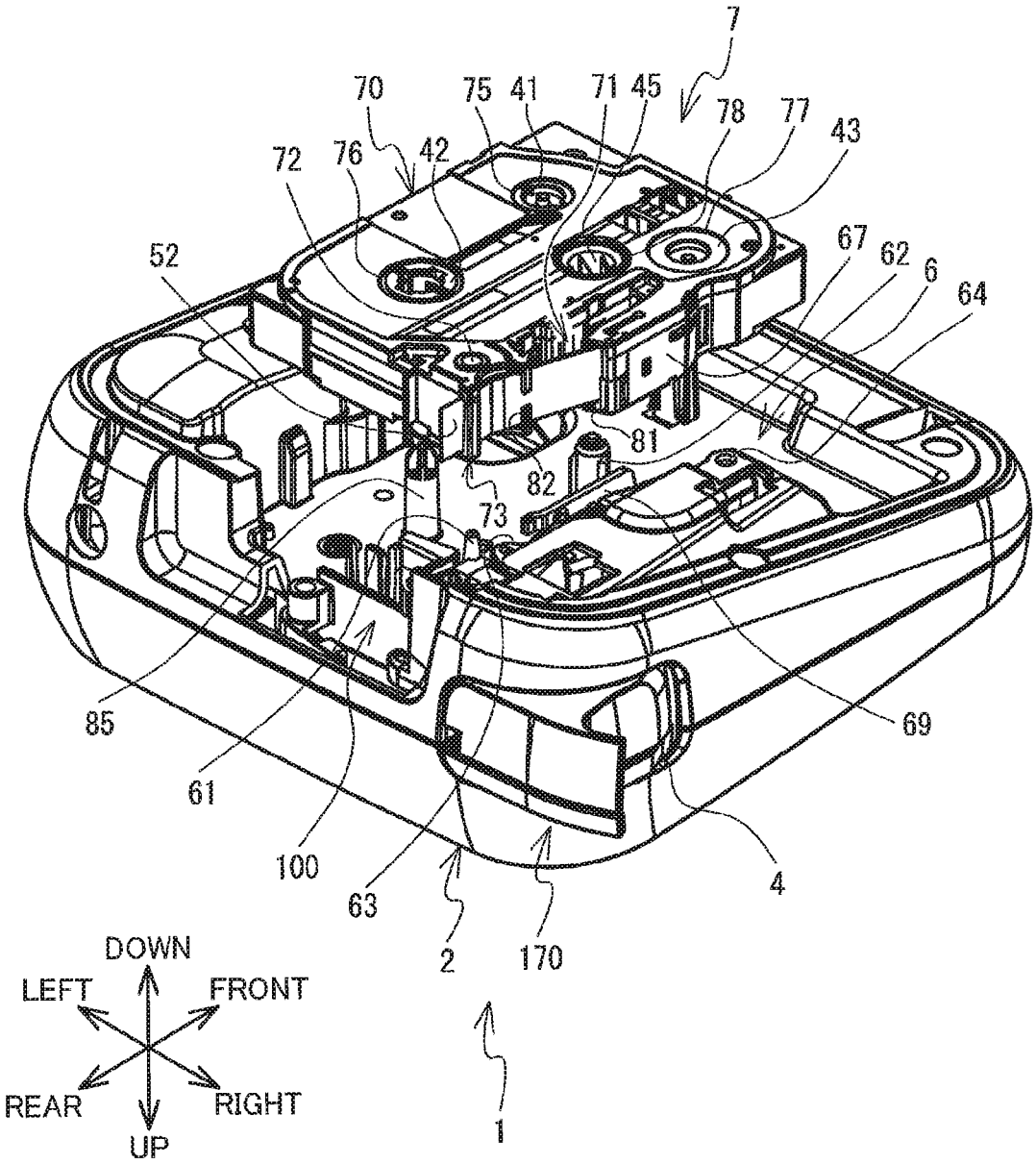
FIG. 2 is another perspective view of a cassette 7 and the printer 1 in which a cover is removed.

As illustrated in FIG. 2, the cassette receiving portion 6 includes a head holder 69, a tape drive shaft 61, a ribbon take-up shaft 62, a drive motor (not illustrated), and an auxiliary shaft 85. The head holder 69 protrudes upward from a right portion of the cassette receiving portion 6. A print head 60 (FIG. 3) is provided at a right surface of the head holder 69. The print head 60 is a thermal head including a plurality of heat generating elements arrayed with each other in an upward/downward direction.

The tape drive shaft 61 is positioned rearward of the head holder 69. The ribbon take-up shaft 62 is positioned leftward of the head holder 69. The tape drive shaft 61 and the ribbon take-up shaft 62 are rotatable about axes extending in the upward/downward direction. The drive motor is drivingly connected to the tape drive shaft 61 and the ribbon take-up shaft 62. The tape drive shaft 61 and the ribbon take-up shaft 62 are interlockingly rotated upon rotation of the drive motor. The auxiliary shaft 85 extends upward and is fixed to the tape receiving portion 6 at a position leftward of the tape drive shaft 61 and the ribbon take-up shaft 62.

Figure 3:
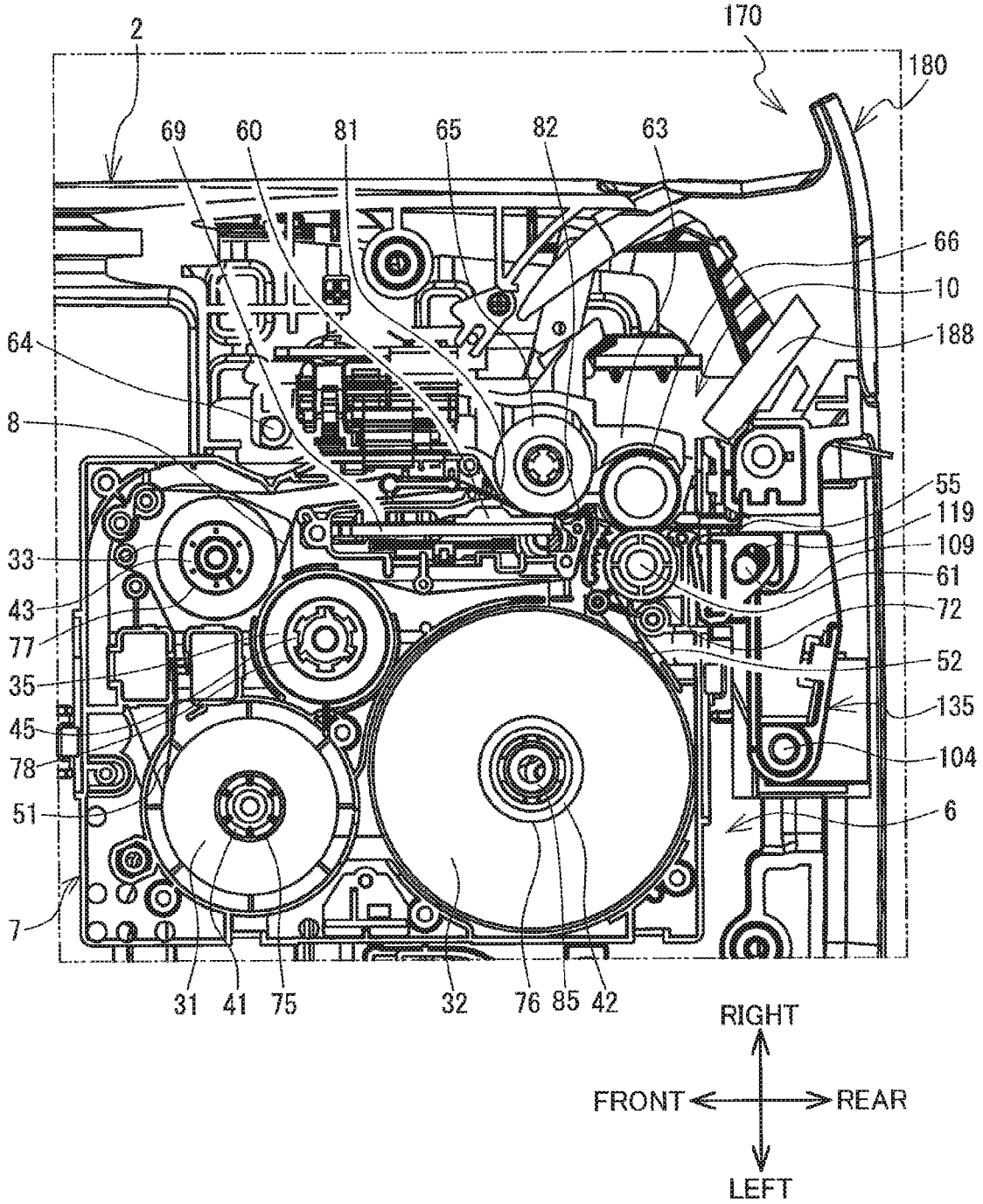
FIG. 3 is a bottom view illustrating an internal structure of the cassette 7 and a cassette receiving portion 6 of the printer.

As illustrated in FIG. 3, a platen holder 63 extending in a frontward/rearward direction is positioned rightward of the cassette receiving portion 6. The platen holder 63 has a front end portion provided with a shaft 64 extending in the upward/downward direction. The platen holder 63 is pivotally movable about an axis of the shaft 64. The platen holder 63 supports a platen roller 65 and a conveyer roller 66. The platen roller 65 and the conveyer roller 66 are rotatable about axes extending in the upward/downward direction.

The platen roller 65 faces the print head 60 from right side. The conveyer roller 66 faces the drive shaft 61 from right side. The platen holder 63 is pivotally movable about an axis of the shaft 64 between a proximity position (FIG. 3) and a remote position (not illustrated). The platen roller 65 and the conveyer roller 66 are positioned closed to the print head 60 and the tape drive shaft 61 at the proximity position of the platen holder 63, respectively. The platen roller 65 and the conveyer roller 66 are moved rightward and positioned away from the print head 60 and the tape drive shaft 61 at the remote position of the platen holder 63, respectively.

The platen roller 65 is switched to a drive-connection state to the drive motor in accordance with the pivotal movement of the platen holder 63 from the remote position to the proximity position. The platen holder 63 is configured to move from the remote position to the proximity position in accordance with the closure of the cassette receiving portion 6 by the cover (not illustrated). A position between the platen roller 65 and the print head 60 when the platen holder 63 is at the proximity position will be referred to as "printing position."

As illustrated in FIG. 2, the cassette 7 is attachable to the cassette receiving portion 6. The cassette 7 is a laminate type cassette, and includes a case 70. The case 70 is box shaped, and accommodates therein a tape drive roller 72, a first tape spool 41, a second tape spool 42, a ribbon spool 43, and a ribbon take-up spool 45. Further, the case 70 is formed with support holes 75, 76, 77, 78 those extending throughout a thickness of the case 70 in the upward/downward direction. Further, the case 70 includes an ejecting portion 73.

The tape drive roller 72 is positioned at a right rear corner portion of the case 70, and has a hollow cylindrical shape extending in the upward/downward direction. The tape drive roller 72 is rotatably supported by the case 70. The tape drive shaft 61 is insertable into the hollow space of the tape drive roller 72. Specifically, the tape drive shaft 61 is inserted into the hollow space of the tape drive roller 72 in a case where the cassette 7 is attached to the cassette receiving portion 6.

The support hole 75 rotatably supports the first tape spool 41. A transparent film tape 51 is wound over the first tape spool 41 to constitute a first tape roll 31. The transparent film tape 51 is configured to be paid out from the first tape roll 31 by the rotation of the first tape roll 31 along with the rotation of the first tape spool 41 about an axis extending in the upward/downward direction.

The support hole 76 rotatably supports the second tape spool 42. The second tape spool 42 has a hollow cylindrical shape. A double-coated adhesive tape 52 is wound over the second tape spool 42 to constitute a second tape roll 32. The double-coated adhesive tape 52 includes a release sheet adhered to one surface thereof. The double-coated adhesive tape 52 is configured to be paid out from the second tape roll 32 by the rotation of the second tape roll 32 along with the rotation of the second tape spool 42 about an axis extending in the upward/downward direction. The double-coated adhesive tape 52 is directed toward the tape drive roller 72. The auxiliary shaft 85 is inserted in a hollow space of the second tape spool 42 when the cassette 7 is attached to the cassette receiving portion 6.

The support hole 77 rotatably supports the ribbon spool 43. A new or non-used ink ribbon 8 is wound over the ribbon spool 43 to constitute a ribbon roll 33. The ink ribbon 8 is configured to be paid out from the ribbon roll 33 by the rotation of the ribbon roll 33 along with the rotation of the ribbon spool 43 about an axis extending in the upward/downward direction.

The support hole 78 rotatably supports the ribbon take-up spool 45. The ribbon take-up spool 45 is hollow cylindrical. A used ink ribbon 8 is wound over the ribbon take-up spool 45 to constitute a ribbon take-up roll 35. The used ink ribbon 8 is configured to be wound over the ribbon take-up roll 35 by the rotation of the ribbon take-up roll 35 along with the rotation of the ribbon take-up spool 45 about an axis extending in the upward/downward direction. The ribbon take-up shaft 62 is inserted into the hollow space of the ribbon take-up spool 45 when the cassette 7 is attached to the cassette receiving portion 6. The ejecting portion 73 has an opening open in the frontward/rearward direction at a right rear portion of the case 10.

A head opening 71 is provided in the case 70. The head opening 71 is an open area in which the head holder 69 is insertable. The head opening 71 is positioned at a right portion of the case 70 and extends throughout a thickness of the case 70 in the upward/downward direction. The case 70 includes an arm portion 67 at a right side of the head opening 71. The arm portion 67 extends in the frontward/rearward direction.

A first tape guide 81 (FIG. 3) is provided at a rear end portion of the arm portion 67. The first tape guide 81 is an opening portion through which the ink ribbon 8 and the transparent film tape 51 positioned rightward of the ink ribbon 8 are discharged.

A second tape guide 82 is positioned between the head opening 71 and the tape drive roller 72. The second tape guide 82 is an opening portion. The transparent film tape 51 and the ink ribbon 8 those discharged out of the first tape guide 81 are configured to pass through the head opening 71, and then directed toward the second tape guide 82.

The ink ribbon 8 is separated from the transparent film tape 51 and is directed leftward at a portion between the second tape guide 82 and the tape drive roller 72. The ink ribbon 8 is then wound over the ribbon take-up roll 35. In the following description, the position at which the ink ribbon 8 is separated from the transparent film tape 51 will be referred to as "peeling position."

The transparent film tape 51 positioned rearward of the peeling position is directed to the tape drive roller 72 where the transparent film tape 51 is superposed with a right surface of the double-coated adhesive tape 52. In the following description, a combination of the transparent film tape 51 and the double-coated adhesive tape 52 superposed with each other will be referred to as "cut item 55". The cut item 55 is a tape whose widthwise direction is the upward/downward direction. The cut item 55 has a thickness of, for example, 100 μm. The cut item 55 is an example of "item to be printed".

A combination of the drive motor, the platen roller 65, the tape drive shaft 61, and the conveyer roller 66 will be generically referred to as "conveying portion 10". In accordance with the closure of the cassette receiving portion 6 by the cover while the cassette 7 is attached to the cassette receiving portion 6, the platen roller 65 and the tape drive shaft 61 rotate in interlocking relation, the tape drive shaft 61 rotates to rotate the tape drive roller 72, the conveyer roller 66 is rotated by the rotation of the tape drive roller 72 upon rotation of the drive motor. Hence, the conveying portion 10 can convey the transparent film tape 51, the ink ribbon 8, and the double-coated adhesive tape 52. In the following description, a direction in which the cut item 55 is conveyed at a position downstream of the first tape guide 81 will be referred to as "conveying direction". The conveying direction is the frontward/rearward direction, a direction toward an upstream side is the frontward direction, and a direction toward a downstream side is the rearward direction.

A cutter unit 100 will be described with reference to FIGS. 4 and 5. The cutter unit 100 is positioned rearward of the tape drive shaft 61 (FIG. 3). The cutter unit 100 includes a cutter portion 150, a lever portion 170, a cradle portion 110, a slide portion 119, and a pin 109. Incidentally, the cutter portion 150 is omitted in FIG. 5.

As described later, the cutter unit 100 performs cutting operation with respect to the cut item 55 by cooperation of a cradle 120 (FIG. 6) of the cradle portion 110 and a cutter blade 155 (FIG. 6) of the cutter portion 150. The cutting operation is performed by user's operation to the lever portion 170. The cutting operation includes half-cut operation and full-cut operation. In the cutting operation, a thickness direction of the cut item 55 is leftward/rightward direction.

According to the full-cut operation, the cut item 55 is completely cut in an extending direction of the cutter blade 155 throughout the entire thickness of the cut item. The extending direction of the cutter blade 155 is a first direction, which is upward/downward direction. According to the half-cut operation, only a right portion of the cut item 55 is cut in the extending direction, and a left portion of the cut item 55 remains uncut. That is, cutting depth of the cutter blade 155 is not the entire thickness of the cut item 55, but only the right portion of the cut item 55 in the thickness direction is cut. Incidentally, in the half-cut operation, the cutting depth of the cutter blade 155 is not limited to one half thickness of the cut item 55. In other words, the cutter blade 155 may be configured to cut half or more of the thickness of the cut item 55, or to cut half or less of the thickness of the cut item 55. That is, the term "half-cut" includes the meaning of "partially-cut" or "incomplete-cut".

The cutter portion 150 includes a box-like member 152, a cutter holder 153, and a cutter spring (not illustrated). The box-like member 152 is open leftward. The box-like member 152 has a right end portion whose center portion in upward/downward direction is formed with an open space hole 152A opening rightward, frontward and rearward. The cutter holder 153 is positioned inside the box-like member 152 and is movable in leftward/rightward direction within its movable range between a leftmost position and a rightmost position. The cutter holder 153 has a left end portion where the cutter blade 155 for cutting the cut item 55 is held.

Figure 6:
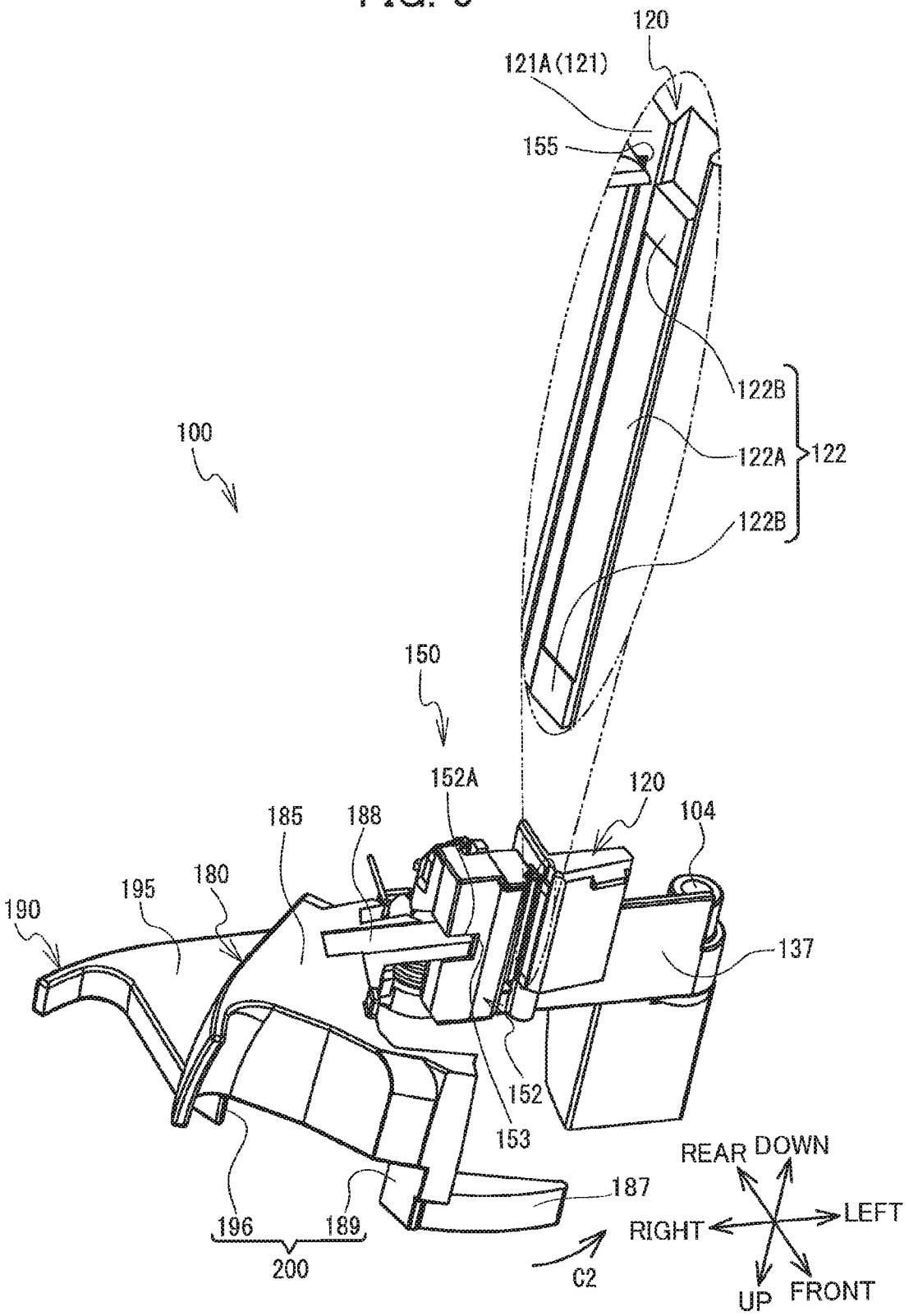
FIG. 6 is a perspective view of the cutter unit 100 in its full-cut state.

The cutter blade 155 is plate shaped having a thickness in frontward/rearward direction, and has a left end portion having a blade edge extending in upward/downward direction. The cutter blade 155 is movable in leftward/rightward direction along with the cutter holder 153. The cutter blade 155 protrudes leftward from the box-like member 152 when the cutter holder 153 is at its leftmost position (FIG. 6). Incidentally, the cutter holder 153 illustrated in FIG. 4 is at its rightmost position.

The lever portion 170 is pivotally movably supported by the housing 2. The lever portion 170 includes a pivot shaft 175, a cutter lever 180, a cradle lever 190, a cutter lever spring 178, and a cradle lever spring 179. The cutter lever spring 178 is omitted in FIG. 5. The pivot shaft 175 extends in upward/downward direction, and is fixed to an internal portion of the housing 2. The pivot shaft 175 is an example of a "pivot shaft".

The cutter lever 180 includes a sleeve portion 182, an operating portion 185, an entry portion 188, a protrusion 189, and an extending portion 187. The sleeve portion 182 has a hollow cylindrical shape opening in upward/downward direction. The sleeve portion 182 is fitted with the pivot shaft 175 and is rotatable relative to the pivot shaft 175. The operating portion 185 extends outwardly from the sleeve portion 182 in a radial direction of the pivot shaft 175. Hence, the operating portion 185 is pivotally movable about the pivot shaft 175. The operating portion 185 is accessible to a user for operation. Specifically, the operating portion 185 has a portion protruding diagonally rearward and rightward from the slot 4 of the housing 2.

The entry portion 188 extends linearly from the operating portion 185 toward a counterclockwise side about the pivot shaft 175 as a center determining the counterclockwise direction in a bottom view. The entry portion 188 is configured to enter into the open space hole 152A of the box-like member 152 to contact the cutter holder 153 as a result of pivotal movement of the cutter lever 180 about the pivot shaft 175. As illustrated in FIG. 6, the protrusion 189 extends upward from the operating portion 185, and the extending portion 187 extends from the protrusion 189 in a direction approximately parallel to the extending direction of the entry portion 188.

The cradle lever 190 includes an arm portion 192, an operating portion 195, and a contact portion 196. The arm portion 192 is pivotally movable about the pivot shaft 175, and is positioned above the cutter lever 180. The arm portion 192 includes a first arm 192A and a second arm 192B integral therewith. The first arm 192A and the second arm 192B extend in the direction approximately opposite to each other with respect to the pivot shaft 175.

The operating portion 195 extends from an upper end portion of the second arm 192B in a direction approximately opposite to the extending direction of the first arm 192A. The operating portion 195 is positioned above the operating portion 185 of the cutter lever 180, and protrudes diagonally rearward and rightward from the slot 4 of the housing 2. The operating portion 195 is accessible to the user for operation, and has a shape approximately the same as the shape of the operating portion 185 in a plan view.

The contact portion 196 is a leading end portion of the operating portion 195 in the counterclockwise direction about the pivot shaft 175 in bottom view, and an outermost end portion of the operating portion 195 in the radial direction of the pivot shaft 175. The contact portion 196 is contactable with the protrusion 189. A combination of the contact portion 196 and the protrusion 189 will be generically referred to as a "transmitting portion 200".

The cutter lever spring 178 (FIG. 4) is a torsion spring provided at the pivot shaft 175. The cutter lever spring 178 urges the cutter lever 180 in a pivotally moving direction as indicated by an arrow C1 (FIGS. 4 and 5) so that the protrusion 189 is urged toward the contact portion 196. The cradle lever spring 179 is a torsion spring provided at the pivot shaft 175, and is positioned below the cutter lever spring 178. The cradle lever spring 179 urges the cradle lever 190 in a direction indicated by the arrow C1. The cradle lever spring 179 is an example of an "first urging member".

Figure 4:
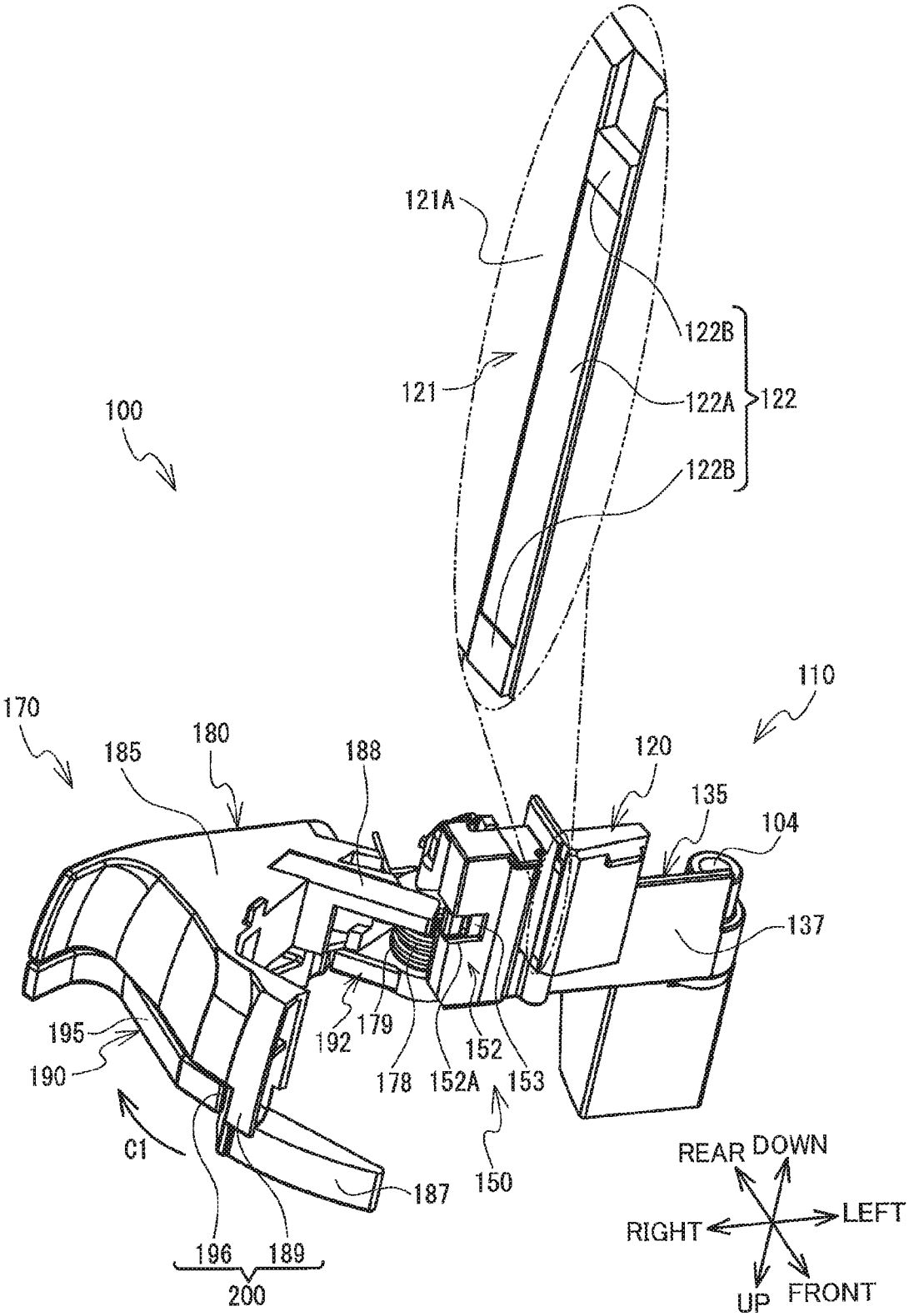
FIG. 4 is a perspective view of a cutter unit 100 in its initial state according to one embodiment.
Figure 5:
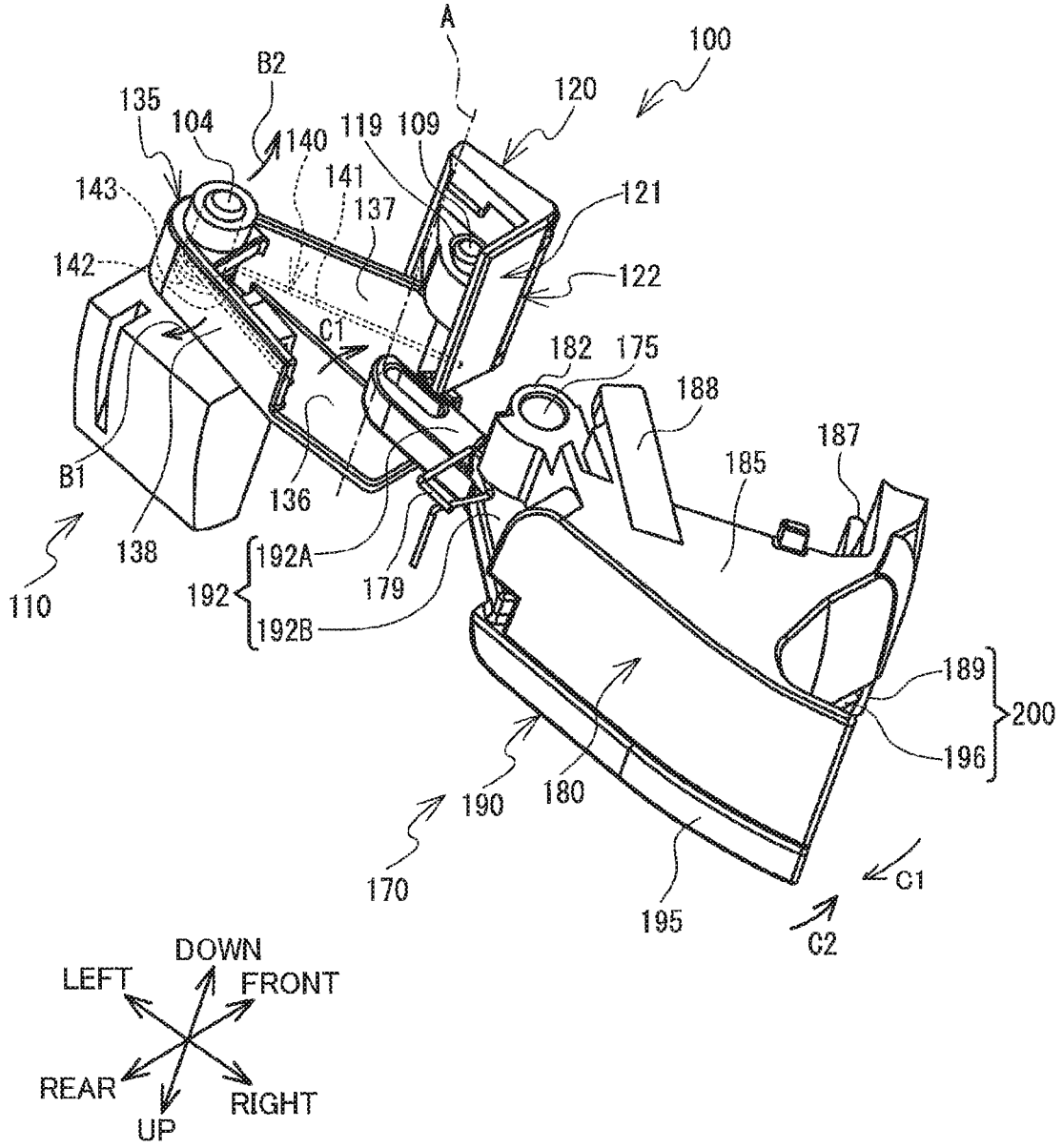
FIG. 5 is another perspective view of the cutter unit 100 in its initial state.

FIGS. 4 and 5 illustrate a state where the cutter lever 180 and the cradle lever 190 are not operated by the user. In this case, the cutter lever 180 is brought at a pivot position by the urging force of the cutter lever spring 178 such that the protrusion 189 approaches the contact portion 196 with a minute clearance therebetween. In this state, the cutter lever 180 is positioned by abutment with the lever stopper (not illustrated) fixed to the inner portion of the housing 2. his pivot position of the cutter lever 180 will be referred to as a "first standby pivot position". Further, the first arm 192A of the cradle lever 190 is brought to a pivot position by the urging force of the cradle lever spring 179 such that the first arm 192A is pressed against a wall portion 137 (described later) of the cradle 120. This pivot position of the cradle lever 190 will be referred to as a "second standby pivot position".

The cradle portion 110 is movably supported by the housing 2. The cradle portion 110 includes the cradle 120, a pivot member 135, and a spring 140. Incidentally, the spring 140 is omitted in FIG. 4. The cradle 120 has a shape of generally rectangular parallelepiped extending in upward/downward direction, and is positioned to face the cutter holder 153 such that the cradle 120 is positioned leftward of the cutter holder 153.

The cradle 120 is formed with an opening 111 (FIG. 7) opening upward, through which the extension portion 113 of the housing 2 extends. The extension portion 113 is one of components of the cutter unit 100. Ina bottom view, the opening 111 has an area greater than a cross-sectional area of the extension portion 113. Hence, the cradle portion 110 is attachable to and detachable from the extension portion 113. In the attached state of the cradle portion 110 to the extension portion 113, an outer surface of the extension portion 113 and an inner surface of the opening 111 face with each other in a second direction with a gap 115 therebetween. The second direction crosses the first direction, and specifically, the second direction is a circumferential direction whose center is at an axis A (FIG. 5). The extension portion 113 is in linear alignment with a locus of the cutter blade 155 in leftward/rightward direction.

The extension portion 113 and the pivot shaft 175 are fixed to the fixing portion of the housing 2. In other words, the extension portion 113 and the pivot shaft 175 are fixed to each other. The fixing portion is a metal plate having a thickness in upward/downward direction. Instead of the metal plate, the fixing portion may be integral with the extension portion 113 and the pivot shaft 175.

As illustrated in FIG. 4, the cradle 120 is includes a first portion 121 and a second portion 122. The first portion 121 and the second portion 122 are arrayed with each other in frontward/rearward direction and the first portion 121 is positioned rearward of the second portion 122. In other words, the first portion 121 and the second portion 122 are at different positions in the conveying direction.

The first portion 121 is configured to nip the cut item 55 in cooperation with the cutter blade 155, and constitutes a rear portion of the cradle 120 for performing full-cut operation. The first portion 121 is made from resin and has a flat right end surface 121A. The second portion 122 is configured to nip the cut item 55 in cooperation with the cutter blade 155, and constitutes a front portion of the cradle 120 for performing half-cut operation. The second portion 122 is made from metal, and has a flat surface portion 122A and a pair of protruding portions 122B. The flat surface portion 122A is approximately flush with the right end surface 121A, and has a length in upward/downward direction slightly greater than that of (widthwise length of) the cut item 55.

Each of the protruding portions 122B is positioned beside each end in upward/downward direction of the flat surface portion 122A so as to spaced away from each other in upward/downward direction. A minimum gap length between the pair of protruding portions 122B and 122B is slightly greater than the length in upward/downward direction (widthwise length) of the cut item 55, so that the cut item 55 can be positioned between the pair of protruding portions 122B and 122B. Each protruding portion 122B protrudes rightward from the flat surface portion 122A by a length greater than 0 m and not more than 70 m. In the depicted embodiment, the protruding length is 50 m. Hence, when the cut item 55 is positioned on the flat surface portion 122A and between the pair of protruding portions 122B, a right surface of the cut item 55 is positioned rightward of a right end surface of each protruding portion 122B.

As illustrated in FIG. 5, the pivot member 135 is pivotally movable about a shaft 104 fixed to the inner portion of the housing 2. The shaft 104 extends in the first direction (that is, upward/downward direction). The pivot member 135 includes a base portion 136, the wall portion 137, and a second wall portion 138. The base portion 136 is pivotally movable about the shaft 104. The base portion 136 extends in a direction perpendicular to upward/downward direction. The base portion 136 is formed with a through-hole (not illustrated) extending throughout a thickness thereof in upward/downward direction.

The wall portion 137 protrudes downward from one end portion of the base portion 136 in a pivot moving direction of the pivot member 135. In other words, protruding direction of the wall portion 137 crosses the pivot moving direction of the pivot member 135. The wall portion 137 is positioned to face with the first arm 192A of the cradle lever 190 in a pivotally moving direction of the first arm 192A. The wall portion 137 is contactable with the first arm 192A. The second wall portion 138 protrudes downward from another end portion of the second wall portion 138 in the pivot moving direction of the pivot member 135.

The spring 140 is a torsion spring including a coil portion 143, a first arm 141 and a second arm 142. The coil portion 143 is disposed over the shaft 104. The coil portion 143 extends through the through-hole (not illustrated) of the base portion 136, such that an upper end of the coil portion 143 is positioned above the base portion 136. The first arm 141 extends rightward from an end of the coil portion 143 and is positioned frontward of the wall portion 137.

The first arm 141 is pressed against the fixing member (not illustrated) fixed to the housing 2. The second arm 142 extends from a lower end of the coil portion 143 along the second wall portion 138. The second arm 142 is positioned frontward of the second wall portion 138 and is pressed against the surface of the second wall portion 138 facing the wall portion 137. The spring 140 urges the pivot member 135 in a first pivot direction as indicated by an arrow B1 in FIG. 5. The first pivot direction is clockwise direction in bottom view. The center in the clockwise direction is the axis of the shaft 104.

The slide portion 119 is provided at the cradle 120. The slide portion 119 is an arcuate elongated slot whose center is at an axis A illustrated in FIG. 5. The slide portion 119 is open upward and downward. The pin 109 is provided at the pivot member 135. Specifically, the pin 109 protrudes downward from the wall portion 137, and extends through the slide portion 119. The pin 109 is slidable with respect to the slide portion 119. Further, the pivot member 135 is connected to the cradle 120 by the engagement between the pin 109 and the slide portion 119.

Figure 8:
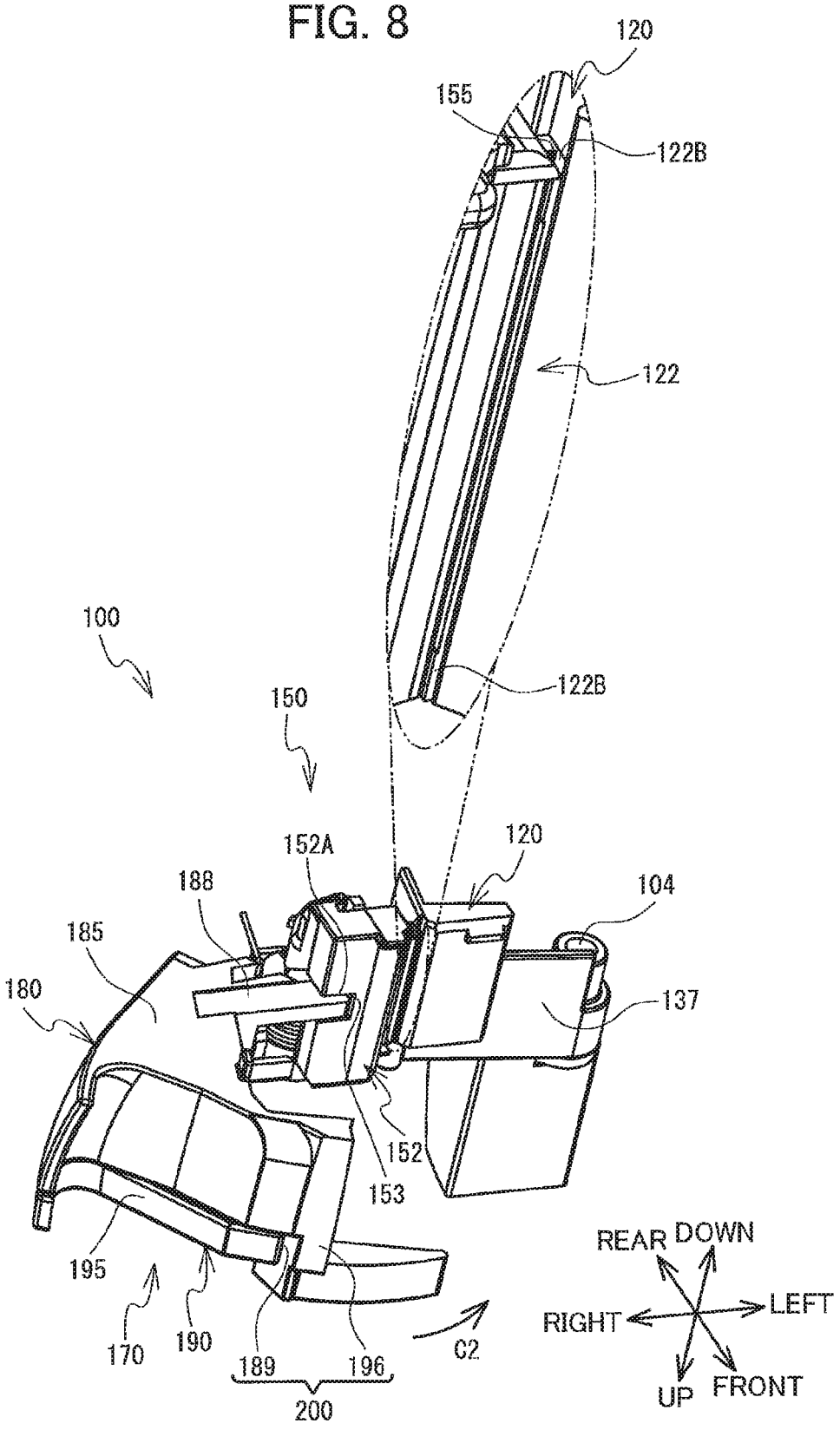
FIG. 8 is a perspective view of the cutter unit 100 in its half-cut state.

In accordance with the pivotal movement of the pivot member 135 about the shaft 104, the pin 109 is slidingly moved relative to the slide portion 119, so that the cradle 120 is pivotally movable about the axis A between a full-cut position (FIGS. 4-6) and a half-cut position (FIG. 8). The cut item 55 is subjected to full-cut operation by the cutter blade 155 in cooperation with the cradle 120 when the cradle 120 is at the full-cut position. In the full-cut position, the first portion 121 faces the cutter blade 155 in the movable direction of the cutter holder 153, i.e., in leftward/rightward direction.

Further, the cut item 55 is subjected to half-cut operation by the cutter blade 155 in cooperation with the cradle 120 when the cradle 120 is at the half-cut position. In the half-cut position, the second portion 122 faces the cutter blade 155 in the movable direction of the cutter holder 153. The cradle 120 is moved from the full-cut position to the half-cut position by pivotally moving the cradle 120 about the axis A in clockwise direction in the bottom view.

As described above, the cutter lever 180 and the cradle lever 190 are at the first standby pivot position, and the second standby pivot position, respectively, in a case where the user does not operate the cutter lever 180 or cradle lever 190. In this state, the first arm 192A presses against the wall portion 137 by the urging force of the cradle lever spring 179 in the direction indicated by the arrow C1. Here, the spring 140 urges the pivot member 135 in the first pivot direction as indicated by the arrow B1 in FIG. 5. However, since the urging force directing in the direction of the arrow C1 is greater than the urging force directing in the direction of the arrow B1, the pivot member 135 can be held at an initial pivot position illustrated in FIG. 4.

In this state, the pin 109 is in contact with an end in a longitudinal direction of the slide portion 119 maintaining the cradle 120 at the full-cut position. Incidentally, a gap length (length Li in FIG. 7) is provided. The gap length is a length in the longitudinal direction of the slide portion 119 from the another end in the longitudinal direction of the slide portion 119 to the pin 109 when the pin 109 is in contact with the one end of the slide portion 119. The gap length is sufficiently smaller than a specific pivotal moving stroke length of the entry portion 188. This stroke length is a pivotally moving distance of the entry portion 188 from a position of the entry portion 188 when the entry portion 188 is at the first standby pivot position to a position of the entry portion 188 when the entry portion 188 is in abutment with the cutter holder 153.

Printing process performed in the printer 1 will next be described with reference to FIGS. 1 through 3. In the open state of the cover, the platen holder 63 is at the remote position. When the cassette 7 is attached to the cassette receiving portion 6 by a user, the ribbon take-up shaft 62 is inserted in the ribbon take-up spool 45, and at the same time, the tape drive shaft 61 is inserted in the tape drive roller 72, and the head holder 69 is inserted in the head opening 71. In this state, widthwise direction of the transparent film tape 51, the ink ribbon 8, and the double-coated adhesive tape 52 is the upward/downward direction.

Then, the platen holder 63 moves from the remote position to the proximity position by closing the cover. As a result, the platen roller 65 presses against the thermal head 60 with interposing the ink ribbon 8 and the transparent film tape 51 between the platen roller 65 and the thermal head 60. The conveyer roller 66 presses against the tape drive roller 72 with interposing the double-coated adhesive tape 52 and the transparent film tape 51 between the conveyer roller 66 and the tape drive roller 72.

Then, the drive motor is energized in response to the user's input to the operating portion 9 as an instruction of start of printing, so that the tape drive shaft 61, the platen roller 65, and the ribbon take-up shaft 62 rotate. The tape drive roller 72 is rotationally driven by the rotation of the tape drive shaft 61, and the conveyer roller 66 is rotated by the rotation of the tape drive roller 72. Hence, the double-coated adhesive tape 52, the transparent film tape 51, and the ink ribbon 8 are conveyed.

The double-coated adhesive tape 52 is paid out from the second tape roll 32. The transparent film tape 51 is paid out from the first tape roll 31. At the same time, the ink ribbon 8 is paid out from the ribbon roll 33. The transparent film tape 51 and the ink ribbon 8 are ejected through the first tape guide 81 and are directed to the printing position by the rotation of the drive motor.

Ink contained in the ink ribbon 8 is transferred to the transparent film tape 51 by the heat generated at the print head 60, whereupon a character is printed on the transparent film tape 51 positioned at the printing position. Letters, figures, numerals, and marks are examples of character. The transparent film tape 51 and the used ink ribbon 8 are conveyed toward the second tape guide 82 by the rotation of the platen roller 65 and the ribbon take-up shaft 62.

After the ink ribbon 8 is entered into the second tape guide 82, the ink contained in the ink ribbon 8 is released from the ink ribbon 8 by the separation of the ink ribbon 8 from the transparent film tape 51 at the peeling position. The used ink ribbon 8 moved past the peeling position is wound over the ribbon take-up roll 35 rotated by the ribbon take-up shaft 62. The printed transparent film tape 51 moved past the peeling position is directed to the second tape guide 82 by the rotation of the conveyer roller 66 and the tape drive roller 72.

At a position between the tape drive roller 72 and the conveyer roller 66, one surface of the double-coated adhesive tape 52 is stuck to the transparent film tape 51 moved past the second tape guide 82. Hence, the cut item 55 is provided. The cut item 55 is conveyed to the ejecting portion 73. The cut item 55 moved past the ejecting portion 73 passes through the cutter unit 100, and is discharged toward a rear side of the housing 2. Then, the printer 1 permits the drive motor and the print head 60 to stop operation to terminate printing. Thereafter, subsequent printing operation can be performed by user's input to the operating portion as instruction of start of printing.

Figure 7:
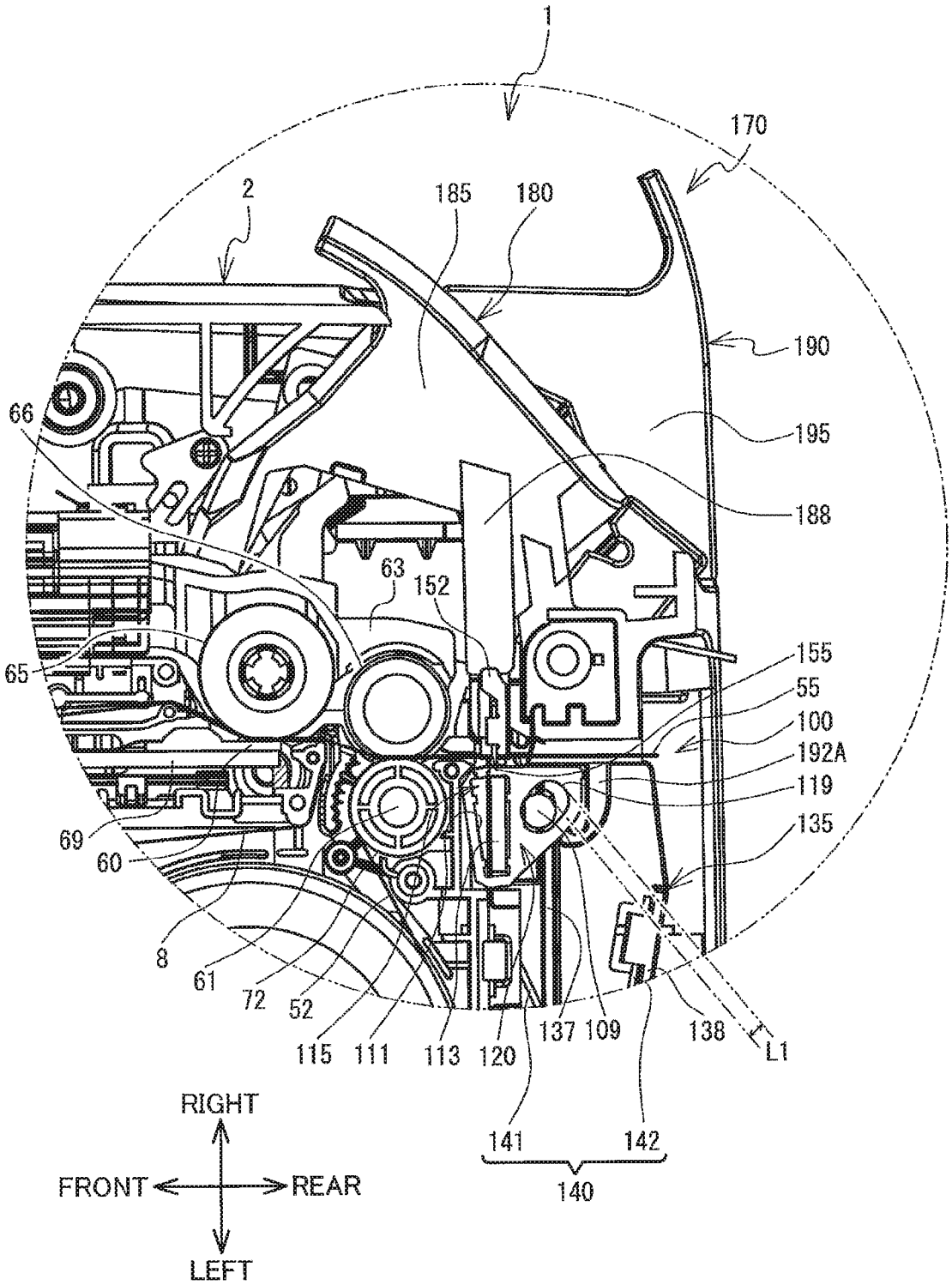
FIG. 7 is an enlarged bottom view of the cutter unit 100 in its full-cut state.

Full-cutting operation will be described with reference to FIGS. 5 through 7. Full-cutting operation is performed, for example, after completion of plurality of times of printing operation. Prior to performing full-cutting operation, the cutter unit 100 is at an initial state, where the cutter lever 180 is at the first standby pivot position, the cradle lever 190 is at the second standby pivot position, the cutter holder 153 is at a rightmost end of its movable range, the pivot member 135 is at the initial pivot position, and the cradle 120 is at the full-cut position.

In the following description, the cut item 55 on which an image is printed is assumed to be positioned between the cutter blade 155 and the cradle 120 when the cutter unit 100 is at the initial state. However, the cut item 55 is not illustrated in FIGS. 5, 6 and 8 for simplicity. The cut item 55 is at the position between the pair of protruding portions 122B in upward/downward direction.

To perform full-cut operation, the cradle lever 190 is not operated, but only the cutter lever 180 is operated by the user. The cutter lever 180 pivotally moves in the direction indicated by the arrow C2 (FIGS. 5 and 6) by the user's operating force against the urging force of the cutter lever spring 178 (FIG. 4), so that the entry portion 188 moves toward and approaches the cutter holder 153.

In accordance with the pivotal movement of the cutter lever 180, the protrusion 189 moves away from the contact portion 196 as illustrated in FIG. 6. In other words, the transmitting portion 200 shuts off transmission of movement of the cutter lever 180 to the cradle lever 190 (i.e., to the cradle 120). At this time, by the urging force of the cradle lever spring 179, the position of the cradle lever 190 is maintained at the second standby position, the position of the pivot member 135 is maintained at the initial pivot position, and the position of the cradle 120 is maintained at the full-cut position. That is, the cradle lever spring 179 urges the cradle 120 toward the full-cut position.

In accordance with the further pivotal movement of the cutter lever 180, the entry portion 188 enters into the open space hole 152A and is brought into contact with the cutter holder 153. The entry portion 188 moves the cutter holder 153 leftward against the urging force of the cutter spring (not illustrated). The cutter blade 155 moving along with the cutter holder 153 nips the cut item 55 in cooperation with the right end surface 121A of the first portion 121. In other words, the first portion 121 nips the cut item 55 in cooperation with the cutter blade 155, when the cradle 120 is at the full-cut position.

In accordance with further pivotal movement of the cutter lever 180, the cutter blade 155 further presses the cut item 55 toward the right end surface 121A. Since the first portion 121 is made from resin, the cutter blade 155 enters into the first portion 121. Hence, the cut item 55 is completely cut in upward/downward direction, that is full-cutting is completed.

User's operation to the cutter lever 180 is finished at a time when the user releases his hold on the cutter lever 180. At this time, the cutter lever 180 pivotally moves by the urging force of the cutter lever spring 178 to restore its first standby pivot position.

Figure 9:
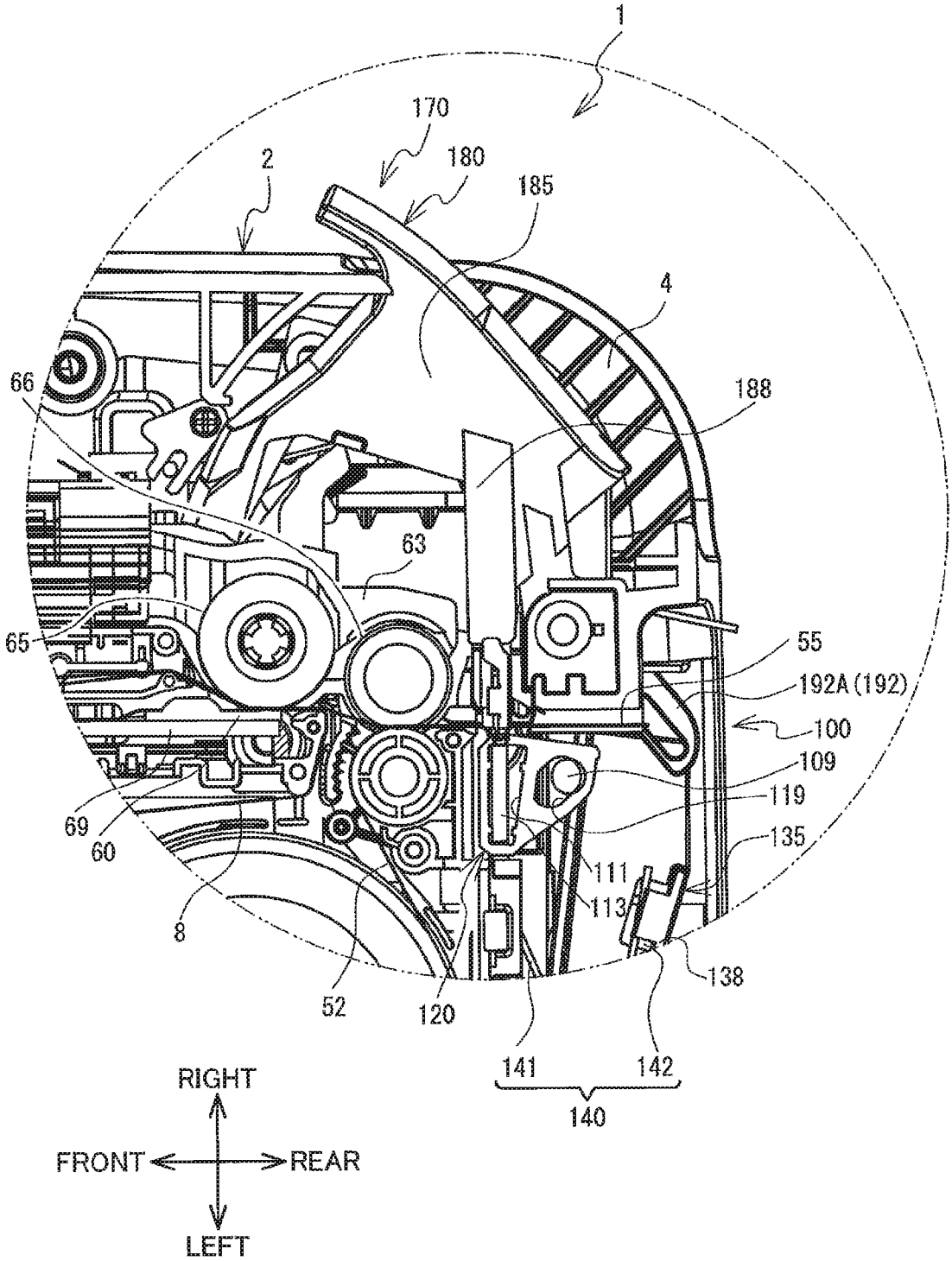
FIG. 9 is an enlarged bottom view of the cutter unit 100 in its half-cut state.

Half-cut operation will be described with reference to FIGS. 4, 8 and 9. Prior to performing half-cutting operation, the cutter unit 100 is at an initial state. Half-cutting operation is performed, for example, each time each printing operation is performed. That is, half-cutting operation is performed prior to full-cutting operation.

To perform half-cut operation, the cutter lever 180 is not operated, but only the cradle lever 190 is operated by the user. The cradle lever 190 pivotally moves in the direction indicated by the arrow C2 from the second standby pivot position by the user's operating force against the urging force of the cradle lever spring 179. In accordance with the pivotal movement of the cradle lever 190, the contact portion 196 urges the protrusion 189, so that the cutter lever 180 also pivotally moves in the direction of the arrow C2 from the first standby pivot position against the urging force of the cutter lever spring 178. In other words, the transmitting portion 200 transmits movement of the cradle lever 190 to the cutter lever 180, so that the cradle lever 190 and the cutter lever 180 pivotally move integrally against urging force of the cutter lever spring 178 and the cradle lever spring 179.

Immediately after start of pivotal movement of the cradle lever 190, the pivot member 135 pivotally moves in the first pivot direction as indicated by the arrow B1 by the urging force of the spring 140, because the first arm 192A pivotally moves in the direction C2. In this case, the contact between the wall portion 137 and the first arm 192A is maintained.

At this time, the pin 109 moves in the first pivot direction along with the pivot member 135, so that the pin 109 slidingly moves with respect to the slide portion 119. Hence, the cradle 120 is moved about the axis A (FIG. 5) from the full-cut position to the half-cut position. In other words, the cradle 120 moves in the direction opposite to the urging direction of the cradle lever spring 179.

In accordance with the movement of the cradle 120, the dimension of the gap 115 (FIG. 7) is reduced. That is, the gap between a front end surface of the extension portion 113 and a front inner surface of the opening 111 is reduced (compare FIG. 7 with FIG. 9). Further, the cradle 120 is brought into abutment with the inner surface of the opening 111, and hence the position of the cradle 120 is fixed at the half-cut position. In this state, the pivot position of the cradle lever 190 will be referred to as "first pivot position".

The cradle lever 190 and the cutter lever 180 further pivotally move integrally. After the cradle lever 190 moves past the first pivot position, the first arm 192A of the cradle lever 190 moves away from the wall portion 137 as illustrated in FIG. 9, since the position of the wall portion 137 is fixed by the positioning of the cradle 120. Further, the entry portion 188 of the cutter lever 180 moves toward the cutter holder 153. After the contact of the entry portion 188 with the cutter holder 153, the entry portion 188 presses the cutter holder 153 in a manner the same as the full-cutting operation. Therefore, the cutter blade 155 moves toward the cut item 55 along with the cutter holder 153. Then, the cutter blade 155 is brought into contact with the cut item 55. In this state, the pivot position of the cradle lever 190 will be referred to as "second pivot position".

When the cradle lever 190 and the cutter lever 180 further pivotally move, the cutter blade 155 nips the cut item 55 in cooperation with the second portion 122. Here, only the right end portion of the cut item 55 positioned on the flat plane 122A is positioned rightward of the pair of protruding portions 122B. The cutter blade 155 forcibly enters into the right end portion of the cut item 55 and contacts the pair of protruding portions 122B. Hence, the right end portion of the cut item 55 is cut in upward/downward direction. In this way the half-cutting operation is performed.

Since the second portion 122 is made from metal, the pair of protruding portions 122B is unlikely to be deformed against the pressing force from the cutter blade 155. Therefore, the position in leftward/rightward direction. of the pair of protruding portions 122B is unlikely to be changed. Accordingly, even cutting depth in the leftward/rightward direction can be obtained over widthwise length of the cut item 55.

After half-cutting operation, user's operation to the cradle lever 190 is finished at a time when the user releases his hold on the cradle lever 190. As a result, by the urging forces of the cutter lever spring 178, the cradle lever spring 179, and the spring 140, the cutter lever 180 is returned to its first standby pivot position, the cradle lever 190 is returned to its second standby pivot position, the pivot member 135 moves past the its second pivot position and the first pivot position and is returned to its initial pivot position, and the cradle 120 is returns to its full-cut position. Further, the gap 115 restores its original dimension (FIG. 7). Consequently, the cutter unit 100 restores its initial state.

Incidentally, for performing the half-cutting operation, the user may operate both the cradle lever 190 and the cutter lever 180. In this case, the cradle lever 190 and the cutter lever 180 are integrally pivotally moved, so that the half-cutting operation can be performed in a manner described above.

As described above, the cutter unit 100 includes the cutter holder 153, the cradle 120, the cutter lever 180, the cradle lever 190, and the transmitting portion 200. The cutter holder 153 holds the cutter blade 155 for cutting the cut item 55, and is movable in leftward/rightward direction. The cradle 120 is positioned to face the cutter holder 153 and is movable between the full-cut position and the half-cut position. The cutter lever 180 is accessible to the user for user's operation, and is configured to contact with and move the cutter holder 153. The cradle lever 190 is accessible to the user for user's operation. The cradle lever 190 is configured to contact with and move the cradle 120.

For performing the full-cutting operation, only the cutter lever 180 is operated by the user. In this case, the transmitting portion 200 cuts off transmission of movement of the cutter lever 180 to the cradle 120. For performing the half-cutting operation, only the cradle lever 190 is operated by the user. In this case, the transmitting portion 200 transmits movement of the cradle lever 190 to the cutter lever 180.

With the structure described above, the cutter unit 100 can perform full-cutting operation or half-cutting operation by user's operation to the cutter lever 180 or to the cradle lever 190. A motor as a drive source for cutting operation is not required in the cutter unit 100. Specifically, a motor for moving the cutter holder 153 is not needed. Thus, a light weight cutter unit 100 can be provided.

For performing half-cutting operation, the cradle lever 190 pivotally moves moving past the first pivot position and the second pivot position. Here, the cradle 120 is already positioned at the half-cut position when the cradle lever 190 is positioned at the first pivot position. That is, a timing at which the movement of the cradle 120 is completed is earlier than a timing at which the cutter blade 155 contacts the cut item 55 by user's operation to the cradle lever 190. Since, the cradle 120 can be moved to the half-cut position before the cutter blade 155 contacts the cut item 55, cutting failure with respect to the cut item 55 can be restrained.

Further, the cutter lever 180 and the cradle lever 190 are both pivotally movable about the pivot shaft 175. In other words, the cutter lever 180 and the cradle lever 190 are both pivotally movable about a common axis extending in upward/downward direction. Accordingly, positional aberration between the cradle lever 190 and the cutter lever 180 can be restrained when the cradle lever 190 is operated by the user.

Further, the cradle 120 is movable between the full-cut position and the half-cut position about the axis A extending in upward/downward direction. In other words, positional change of the cradle 120 between the full-cut position and the half-cut position is performed in the conveying direction. Accordingly, stabilized positional shifting between the full-cut position and the half-cut position can be performed.

Further, when the cutter unit 100 is in the initial state, the cradle lever spring 179 urges the base portion 136 in the direction (B2) opposite to the first pivot direction (B1) through the first arm 192A, whereupon the pin 109 maintains the cradle 120 at its full-cut position. In other words, the cradle lever spring 179 urges the cradle 120 toward the full-cut position. Because of the provision of the cradle lever spring 179, the full-cut position of the cradle 120 can be easily maintained.

Further, the cradle 120 moves in the direction opposite to the urging direction of the cradle lever spring 179 as a result of user's operation to the cradle lever 190. In this case, the cradle 120 can be easily returned to the full-cut position by the urging force of the cradle lever spring 179 after termination of user's operation to the cradle lever 190.

Further, the second portion 122 of the cradle 120 includes the flat plane 122A and the pair of protruding portions 122B. Each protruding portion 122B protrudes rightward from the flat plane 122A and faces the cutter blade 155 in leftward/rightward direction, which is the moving direction of the cutter holder 153, when the cradle 120 is at the half-cut position. Protruding amount of the protruding portion 122B is greater than 0 μm and not more than 70 μm. In the half-cut position, the cutter blade 155 contacts the protruding portions 122B and nips the cut item 55 in cooperation with the second portion 122 in accordance with the movement of the cutter holder 153. At this time, since the protruding portions 122B protrude from the flat plane 122A by an amount of greater than 0 μm and not more than 70 μm, stabilized half-cutting operation can be performed with respect to the cut item 55.

Further, the cradle 120 includes the first portion 121 and the second portion 122. The cut item 55 is nipped between the cutter blade 155 and the first portion 121 when the cradle 120 is at the full-cut position. The cut item 55 is nipped between the cutter blade 155 and the second portion 122 when the cradle 120 is at the half-cut position. The first portion 121 is made from resin, and second portion 122 is made from metal. That is the first portion 121 is made from a material different from a material of the second portion 122. Because of this difference in material, full-cut operation and be efficiently switched to half-cut operation and vice versa.

Further, since the first portion 121 is made from resin, the cutter blade 155 can easily move into the first portion 121. Hence, stabilized full-cutting operation can be performed. Further, since the second portion 122 is made from metal, the second portion 122 is unlikely to be deformed. Hence, contacting position between the cutter blade 155 and the protruding portions 122B can be maintained at a constant position in leftward/rightward direction, which is the moving direction of the cutter holder 153. Accordingly, cutting depth in the leftward/rightward direction, with respect to the cut item 55 in the half-cutting operation can be even in upward/downward direction. Thus, stabilized half-cutting operation can be attained.

Further, the cutter unit 100 includes the pivot member 135, the spring 140, the pin 109, and the slide portion 119. The pivot member 135 is pivotally movable about the axis extending in the first direction (upward/downward direction) that is the extending direction of the cutter blade 155. The pivot member 135 includes the wall portion 137. The wall portion 137 extends in the direction crossing the pivotally moving direction of the pivot member 135. The spring 140 urges the pivot member 135 in the first pivot direction B1. The pin 109 is provided at the pivot member 135, and the slide portion 119 is provided at the cradle 120. The pin 109 is slidably movable with respect to the slide portion 119.

When the first arm 192A of the cradle lever 190 is moved in a direction separated from the wall portion 137 by the user's operation to the cradle lever 190, the pin 109 moves in the first pivot direction by the movement of the pivot member 135 in the first pivot direction while the pin 109 slidingly moves with respect to the slide portion 119. In summary, in accordance with the operation to the cradle lever 190 by the user, the pin 109 moving in the first pivot direction slidingly moves along the slide portion 119, so that the cradle 120 is moved from the full-cut position to the half-cut position.

The printer 1 includes the conveying portion 10, the print head 60, and the cutter unit 100. The conveying portion 10 is configured to convey the cut item 55. The print head 60 is configured to perform printing on the cut-item conveyed by the conveying portion 10. The cutter unit 100 is configured to perform full-cutting operation or half-cutting operation to the cut item 55 on which printing is performed by the print head 60. A light-weight printer 1 can be provided by the employment of the lightweight cutter unit 100.

The printer 1 includes the conveying portion 10, the print head 60, and the cutter unit 100, and the cutter unit 100 includes the cutter blade 155, the cradle 120, and the extension portion 113. The cradle 120 is movable between the full-cut position and the half-cut position in accordance with the user's operation to the lever portion 170. The extension portion 113 is inserted in the opening 111 formed in the cradle 120. The outer surface of the extension portion 113 and the inner surface of the opening 111 face with each other in the second direction with the gap 115 therebetween. Size of the gap 115 is changed in accordance with the movement of the cradle 120 in the second direction. Because the cradle 120 can be moved between the full-cut position and the half-cut position by user's operation, a drive source such as a motor for moving the cradle 120 is not required in the printer 1. Thus, a light-weight cutting unit 100 can be provided.

The extension portion 113 is positioned at an extension line in line with the locus of the cutter blade 155, and one of the first portion 121 and the second portion 122 of the cradle 120 is positioned on the extension line. Therefore, positional displacement of the cradle 120 can be restrained when the cut item 55 is nipped between the cutter blade 155 and the cradle 120.

The cradle 120 is attachable to and detachable from the extension portion 113. Therefore, the cradle 120 can be easily exchanged with a new cradle 120.

For half-cutting operation or full-cutting operation, the cutter lever 180 is pivotally moved about the pivot shaft 175, so that the entry portion 188 urges the cutter holder 153 to move the cutter blade 155 leftward. In other words, the cutter lever 180 moves the cutter blade 155 about the pivot shaft 175. Since the extension portion 113 and the pivot shaft 175 are connected to each other through the fixing portion, positional displacement between the cradle 120 and the cutter blade 155 can be restrained.

The present disclosure is not limited to the above described embodiment. For example, a receptor type cassette or a thermal type cassette is available instead of the laminate type cassette 7. Regarding the receptor type cassette (hereinafter simply referred to as "first cassette"), a receptor tape is wound over the first tape spool 41 supported by the support hole 75, the second tape spool 42 is not provided, and the ribbon spool 43 is supported by the support hole 77. In this case, the receptor tape is an example of the cut item.

Regarding the thermal type cassette, a heat sensitive tape or a stencil tape is wound over the first tape spool 41 supported by the support hole 75, and the second tape spool 42 and the ribbon spool 43 are not provided. In this case, the heat sensitive tape or the stencil tape is the example of the cut item. A tube is also available as the cut item instead of the tape. The tube is made from a flexible material such as rubber. Further, an ink ejection head is also available as the print head 60 instead of the thermal head.

In the above-described embodiment, the cradle lever 190 is positioned above the cutter lever 180, and the first arm 192A of the cradle lever 190 urges the cradle 120 by way of the pivot member 135 and the pin 109. However, the cradle lever 190 may be positioned below the cutter lever 180, and the first arm 192A may be in direct contact with the cradle 120.

Further, in the above-described embodiment, the cradle 120 is pivotally movable about the axis A extending in upward/downward direction, and the cradle lever 190 and the cutter lever 180 are pivotally movable about the pivot shaft 175. However, the cradle 120 may be slidably movable in frontward/rearward direction, and one of the cutter lever 180 and the cradle lever 190 may be integral with the pivot shaft 175, so that these may be rotatable about an axis extending in upward/downward direction.

The slide portion 119 may be provided at the pivot member 135 instead of the cradle 120. In this case, the slide portion 119 may have an elongated arcuate slot whose arcuate center is at the shaft 104, and the pin 109 may be provided at the cradle 120 and slidable with respect to the elongated arcuate slot. Further, instead of the elongated slot, the slide portion 119 may be an outer end portion of the pivot member 135 or the cradle 120.

Further, frontward/rearward position of the first portion 121 and the second portion 122 may be reversed to each other. In this case, the spring 140 urges the cradle 120 toward the half-cut position by way of the pivot member 135 and the pin 109. Since the cutter unit 100 includes the spring 140, the cradle 120 can be easily positioned at the half-cut position. Further, the cradle 120 can be easily returned to the half-cut position from the full-cut position after user's operation to the cradle lever 190. Further, in the above-described embodiment, the spring 140 urges the cradle 120 by way of the pivot member 135 and the pin 109. However, the spring 140 may directly contact the cradle 120 to urge the same.

Further, the stopper is not provided at the inner portion of the housing 2. In this case, the protrusion 189 abuts on the contact portion 196 by the urging force of the cutter lever spring 178 when the cutter lever 180 is at the first standby pivot position. Accordingly, when the printer 1 is in the initial state, the first arm 192A urges, by the urging force of the cradle lever spring 179 and the cutter lever spring 178, the wall portion 137 of the pivot member 135 in the direction indicated by the arrow B2 (FIG. 5) opposite to the first pivot direction B1 to maintain full-cut position of the cradle 120.

Figure 10:
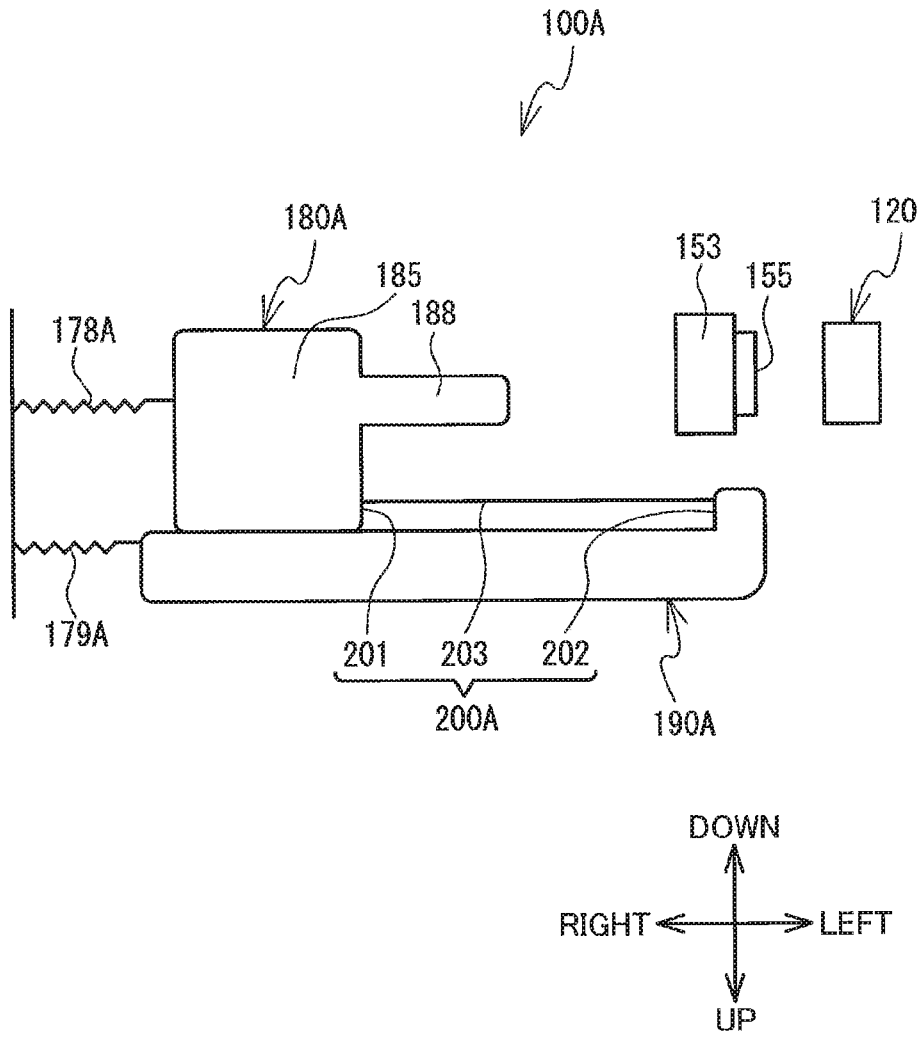
FIG. 10 is a bottom view of a cutter unit 100A according to a first modification.

A cutter unit 100A according to a first modification will be described with reference to FIG. 10, wherein like parts and components are designated by the same reference numerals as those shown in FIGS. 1 through 9. Further, FIG. 10 schematically illustrates the cutting unit 100A.

The cutter unit 100A includes a cutter lever 180A and a cradle lever 190A instead of the cutter lever 180 and the cradle lever 190. The cutter lever 180A is movable in leftward/rightward direction, and includes the entry portion 188. The cradle lever 190A is urged rightward by a cutter lever spring 178A which is a tension spring. The cradle lever 190A is positioned above the cutter lever 180A, and is movable in leftward/rightward direction. The cradle lever 190A is urged rightward by a cradle lever spring 179A which is a tension spring. The cradle 120 is configure to be pivotally movable from the full-cut position to the half-cut position in accordance with leftward movement of the cradle lever 190A.

The cutter unit 100A includes a transmitting portion 200A instead of the transmitting portion 200 (FIG. 4). The transmitting portion 200A includes a first wall 201, a second wall 202, and a connecting portion 203. The first wall 201 is a left wall portion of the cutter lever 180A. The second wall 202 is a left wall portion of the cradle lever 190A, and is positioned leftward of the first wall 201. The connecting portion 203 connects the first wall 201 to the second wall 202. The connecting portion 203 is a wire made from metal or resin, or is a rope made from resin or fabric.

For performing full-cutting operation, only the cutter lever 180A is operated by a user, and is moved leftward against urging force of the cutter lever spring 178A. Since the first wall 201 is moved toward the second wall 202, the connecting portion 203 becomes slack. Hence, the transmitting portion 200A shuts off transmission of movement of the cutter lever 180A to the cradle lever 190A (that is to the cradle 120). At this time, the position of the cradle lever 190A is maintained by the cradle lever spring 179A, so that the position of the cradle 120 is maintained at the full-cut position.

The cutter blade 155 nips the cut item 44 in cooperation with the first portion 121 (FIG. 4) of the cradle 120 when the entry portion 188 of the cradle lever 190A urges the cutter holder 153 leftward. Hence, full-cutting is attained. When the user releases his hold on the cutter lever 180A, the cutter lever 180A restores its original position by the urging force of the cutter lever spring 178A. Incidentally, the first wall 201 is positioned rightward away from the second wall 202 during full-cutting operation.

For performing half-cutting operation, only the cradle lever 190A is operated by the user, and is moved leftward. The second wall 202 is moved leftward along with the cradle lever 190A against urging force of the cradle lever spring 179A, so that the connecting portion 203 is stretched, and hence, the cutter lever 180A is urged and moved leftward against urging force of the cutter lever spring 178A. That is, the transmitting portion 200A transmits movement of the cradle lever 190A to the cutter lever 180A. Accordingly, the cutter lever 180A and the cradle lever 190A are moved integrally.

In accordance with the movement of the cradle lever 190A, the cradle 120 is pivotally moved from the full-cut position to the half-cut position, and the entry portion 188 of the cutter lever 180A urges the cutter holder 153 leftward. Hence, the cut item 55 is nipped between the cutter blade 155 and the second portion 122 (FIG. 4) of the cradle 120. Accordingly, half-cutting is performed with respect to the cut item 55. When the user releases his hold on the cradle lever 190A, the cradle lever 190A and the cutter lever 180A restore their original position by the urging force of the cradle lever spring 179A and the cutter lever spring 178A, and the cradle 120 restores its full-cut position.

A cutter unit 100B according to a second modification will be described with reference to FIG. 11, wherein like parts and components are designated by the same reference numerals as those shown in FIGS. 1 through 9.

The cutter unit 100B includes a driving portion 160. A solenoid is one of examples of the driving portion. The solenoid 160 includes a plunger 161 extending in a direction perpendicular to a longitudinal direction of the slide portion 119, and a pin 129 protruding downward from a tip end portion of the plunger 161. The pin 129 is slidably movable with respect to the slide portion 119. According to the second modification, the cradle lever spring 179 is not employed. That is, the cradle 120 is not urged by the cradle lever spring 179, but is urged by the solenoid 160.

Upon actuation of the solenoid 160, the plunger 161 is displaced in its extending direction, so that the pin 129 is slidingly moved with respect to the cradle 120. As a result, the cradle 120 is movable between the full-cut position and the half-cut position.

Figure 11:
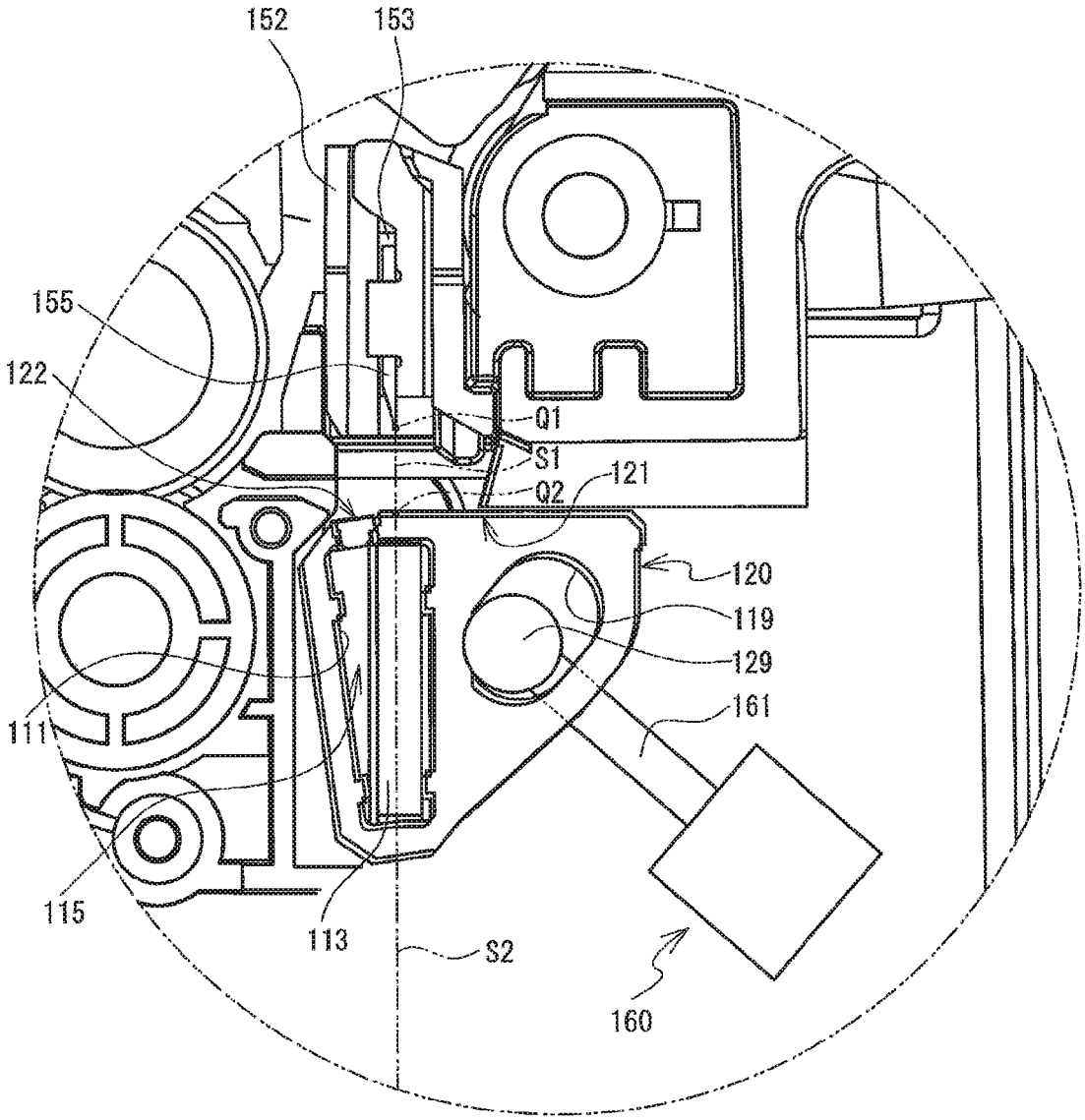
FIG. 11 is a bottom view of a cutter unit 100B according to a second modification.
Figure 11:
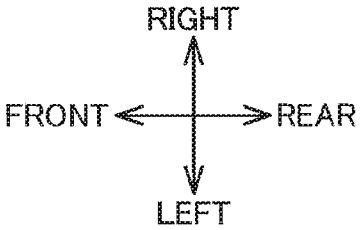

Incidentally, in FIG. 11, a point Q1 and a point Q2 are illustrated. The point Q1 is a tip end of the cutter blade 155, and the point Q2 is abutting point of the cutter blade 155 on the first portion 121. A linear line S obtained by connecting the point Q1 to the point Q2 and extending in leftward/rightward direction, is a locus of the cutter blade 155, and a linear line S2 extending leftward from the point Q2 is an extension line extending from the locus of the cutter blade 155.

In the second modification, a motor may be used instead of the solenoid 160. In the latter case, a gear teeth arrayed in a circumferential direction about the axis A may be provided at a part of the cradle 120, and a motor gear may be fixed to an output shaft of the motor. The gear teeth are in meshing engagement with the motor gear. Upon energization of the motor, the cradle 120 may be movable between the full-cut position and the half-cut position.

While the description has been made in detail with reference to the embodiment and modifications, it will be apparent to those skilled in the art that various changes and modifications, may be made therein without departing from the scope and spirit of the disclosure.

What is claimed is:

1. A cutter unit comprising:

a cutter holder holding a cutter blade for cutting a cut item, the cutter holder being movable in a moving direction;

a cradle facing the cutter holder and movable between a full-cut position where the cut item is subjected to full-cutting with the cutter blade and a half-cut position where the cut item is subjected to half-cutting with the cutter blade;

a cutter lever configured to be operated by a user, and contactable with the cutter holder to move the cutter holder;

a cradle lever configured to be operated by the user, and contactable with the cradle to move the cradle; and a transmitting portion configured to move the cutter lever and the cradle lever in interlocking relation therebetween;

wherein the transmitting portion is configured to shut off transmission of movement of the cutter lever to the cradle lever in accordance with only operation to the cutter lever out of the cutter lever and the cradle lever, and wherein the transmitting portion is configured to transmit movement of the cradle lever to the cutter lever in accordance with only operation to the cradle lever out of the cutter lever and the cradle lever.

2. The cutter unit according to claim 1, wherein the cradle, the cutter lever, the cradle lever, and the transmitting portion are configured to provide a completion timing at which movement of the cradle from the full-cut position to the half-cut position by user's operation to the cradle lever is completed, and a contacting timing at which the cutter blade contacts the cut item in accordance with movement of the cradle lever, the completion timing being earlier than the contacting timing.

3. The cutter unit according to claim 1, wherein the cutter lever is pivotally movable about an axis;

wherein the cradle lever is pivotally movable about the axis.

4. The cutter unit according to claim 1, wherein the full-cutting position and the half-cutting position are arrayed with each other in a conveying direction of the cut item.

5. The cutter unit according to claim 1, further comprising a first urging member configured to urge the cradle to one of the full-cut position and the half-cut position.

6. The cutter unit according to claim 5, further comprising a second urging member configured to urge the cradle in an urging direction opposite to an urging direction of the first urging member as a result of operation to the cradle lever, the second urging member having an urging force smaller than that of the first urging member.

7. The cutter unit according to claim 5, wherein the cradle is movable in a direction opposite to an urging direction of the first urging member as a result of operation to the cradle lever.

8. The cutter unit according to claim 1, wherein the cradle comprises:

a flat surface portion;

a protruding portion protruding from the flat surface portion configured to face the cutter blade in the moving direction, when the cradle is at the half-cut position, the protruding portion protruding from the flat surface portion by a protruding amount of more than 0 μm and not more than 70 μm.

9. The cutter unit according to claim 1, wherein the cradle comprises:

a first portion configured to nip the cut item in cooperation with the cutting blade when the cradle is at the full-cut position; and a second portion configured to nip the cut item in cooperation with the cutting blade when the cradle is at the half-cut position, the second portion being made from a material different from a material of the first portion.

10. The cutter unit according to claim 9, wherein the material of the first portion is resin, and the material of the second portion is metal.

11. The cutter unit according to claim 1, wherein the cutter blade extends in a first direction; the cutter unit further comprising:

a pivot member pivotally movable in a first pivot direction and a second pivot direction opposite to the first pivot direction about an axis extending in the first direction, the pivot member comprising a wall portion extending in a direction crossing the first pivot direction;

a spring urging the pivot member in the first pivot direction;

a pin provided at one of the pivot member and the cradle and extending in the first direction; and a slide portion provided at remaining one of the pivot member and the cradle, the pin being slidably movable relative to the slide portion;

wherein the pin and the slide portion are configured so that pin moves in the first pivot direction while the pin is slidingly moved relative to the slide portion by urging force of the spring when the cradle lever moves away from the wall portion.

12. A printer comprising:

a conveying portion configured to convey a cut item;

a print head configured to perform printing on the cut item conveyed by the conveying portion; and a cutter unit according to claim 1 and configured to selectively perform one of full-cutting and half-cutting operation with respect to the cut item on which printing is performed by the print head.

13. A printer comprising:

a conveying portion configured to convey an item to be printed;

a print head configured to perform printing on the item to be printed conveyed by the conveying portion; and a cutter unit configured to selectively perform one of full-cutting and half-cutting operation with respect to the item on which printing is performed by the print head; the cutter unit comprising:

a cutter blade for cutting the item to be printed, the cutter blade being movable;

a cradle positioned to face the cutter blade and movable in a movable direction between a full-cut position where the item to be printed is subjected to full-cutting with the cutter blade and a half-cut position where the item to be printed is subjected to half-cutting with the cutter blade, the cradle being formed with an opening having an inner surface; and an extension portion positioned in the opening, the extension having an outer surface;

wherein the outer surface of the extension portion and the inner surface of the opening face with each other in the movable direction with a gap therebetween, a dimension of the gap in the movable direction being changed in response to movement of the cradle in the movable direction.

14. The printer according to claim 13, wherein the extension portion is positioned on an extension line extending from a locus of the cutter blade.

15. The printer according to claim 13, wherein the cradle is attachable to and detachable from the extension portion.

16. The printer according to claim 13, further comprising a cutter lever pivotally movable about a pivot shaft;

wherein the pivot shaft and the extension portion are fixed to each other.

* * * * *